US005336049A

United States Patent [19]

Herman

[11] Patent Number: 5,336,049

[45] Date of Patent: Aug. 9, 1994

[54] SALAD BAR FAN

[75] Inventor: Kenneth M. Herman, Lanham, Md.

[73] Assignee: Shoppers Food Warehouse Corp., Lanham, Md.

[21] Appl. No.: 765,934

[22] Filed: Sep. 26, 1991

[51] Int. Cl.[5] ..... A47F 10/02; A47F 10/06

[52] U.S. Cl. ..... 416/146 R; 312/236; 312/237

[58] Field of Search ..... 312/116, 236, 237; 108/50; 416/146 R

[56] References Cited

U.S. PATENT DOCUMENTS

| | | | |
|---|---|---|---|
| D. 244,570 | 6/1977 | Taylor . | |
| D. 282,612 | 2/1986 | Moore, Jr. . | |
| D. 300,591 | 4/1989 | Marchais | D6/481 |
| D. 320,221 | 7/1989 | Suttles et al. | D6/481 |
| 1,772,296 | 8/1930 | Strobell . | |
| 2,734,990 | 2/1956 | Leuscher | 312/237 |
| 2,929,227 | 3/1960 | Rainwater | 312/116 |
| 3,162,495 | 12/1964 | Swift | 312/236 |
| 4,458,501 | 7/1984 | Kooy | 312/236 |
| 4,572,598 | 2/1986 | Moore, Jr. | 312/116 |
| 4,623,367 | 11/1986 | Paulson | 108/50 |
| 4,753,496 | 6/1988 | Bussard | 312/236 |
| 4,850,804 | 7/1989 | Huang | 416/246 |
| 5,114,016 | 5/1992 | Todd | 416/246 |

*Primary Examiner*—Edward K. Look
*Assistant Examiner*—Michael S. Lee
*Attorney, Agent, or Firm*—Cushman, Darby & Cushman

[57] ABSTRACT

A salad bar-type food display and self service unit is provided which includes a base, a table or counter supported by the base, and a fan assembly mounted to the table and disposed above the table for circulating air above the top or display surface of the table. A sneeze/-cough guard may be mounted to overlie the table, in which case the air circulating fan or fans are preferably mounted above the guard. The salad bar unit provides desirable air circulation and a barrier to flying insects without compromising portability and/or requiring structural modification of the store or restaurant in which it is used.

19 Claims, 4 Drawing Sheets

SALAD BAR FAN

BACKGROUND OF THE INVENTION

1. Field of the Invention

The present invention relates to a food display and self serve unit and, in particular, to a salad bar having air circulating fans.

2. Description of the Related Art

Self serve food displays such as salad bars have become popular in restaurants and supermarkets alike to allow the customer to select from a number of prepared food items and condiments. The customer is thus offered a variety of ready-to-eat products and can serve him or herself according to his or her particular tastes or desires. Many salad bars and like self serve displays are in the form of stand alone units which provide access from all sides so that the maximum number of customers can be accommodated at any one time. When such fresh food units are provided, it is desirable to provide for air circulation so that the divergent odors from the various products on display will not commingle and stagnate thus making the presentation less pleasant to the senses. Furthermore, it is desirable to generate an air curtain or barrier to prevent fruit flies and the like from approaching and landing on the product. Circulating fresh air to the vicinity of the food may also help reduce spoilage.

Sometimes a particular restaurant or supermarket will be designed so that ventilation ducting is provided in close proximity to the food display or bar. In addition, or in the alternative, one or more ceiling fans are mounted in proximity to the unit to provide for proper ventilation and to generate an air curtain. Such air ducting or placement of ceiling fans, however, requires that the locus of the food display be determined at the time of original building construction or at least requires remodeling to accommodate the proposed location of the display. This means that the location of the salad bar or like unit cannot be altered without also modifying the location of the fans or ventilation ducting. Mounting of such fans, furthermore, requires that the ceiling be punctured and that suitable support structures and power supply be provided which significantly increases construction costs and delays installation.

SUMMARY OF THE INVENTION

It is an object of the invention to provide a food display and self serve unit which provides desirable air circulation and a barrier to fruit flies and the like without requiring remodeling or alteration of the store or restaurant.

It is also an object of the invention to provide an air circulation system which allows the food display and self serve unit to be temporarily or permanently moved without requiring shifting or modification of ceiling fans or ventilation ducting.

The foregoing and other objects of the invention are realized by providing a food display and self serve unit which incorporates at least one fan assembly for circulating air above and around the display.

Thus in accordance with the invention a salad bar or the like is provided which includes a base, a table or counter supported by the base, and a fan assembly mounted to the table and disposed above the table for circulating air around the top or display surface of the table and for creating an air curtain to keep away fruit flies and the like. A sneeze/cough guard may be mounted to overlie the table, in which case the air circulating fan or fans are preferably mounted above the guard. Thus, the salad bar unit of the invention provides desirable air circulation and a barrier to flying insects without compromising portability and/or requiring structural modification of the store or restaurant in which it is used.

Other objects, features, and characteristics of the present invention, as well as the methods of operation and functions of the related elements of structure, will become more apparent upon consideration of the following description and the appended claims with reference to the accompanying drawings all of which form a part of this specification, wherein like reference numerals designate corresponding parts in the various figures.

DETAILED DESCRIPTION OF THE PRESENTLY PREFERRED EXEMPLARY EMBODIMENTS

Figure 1:
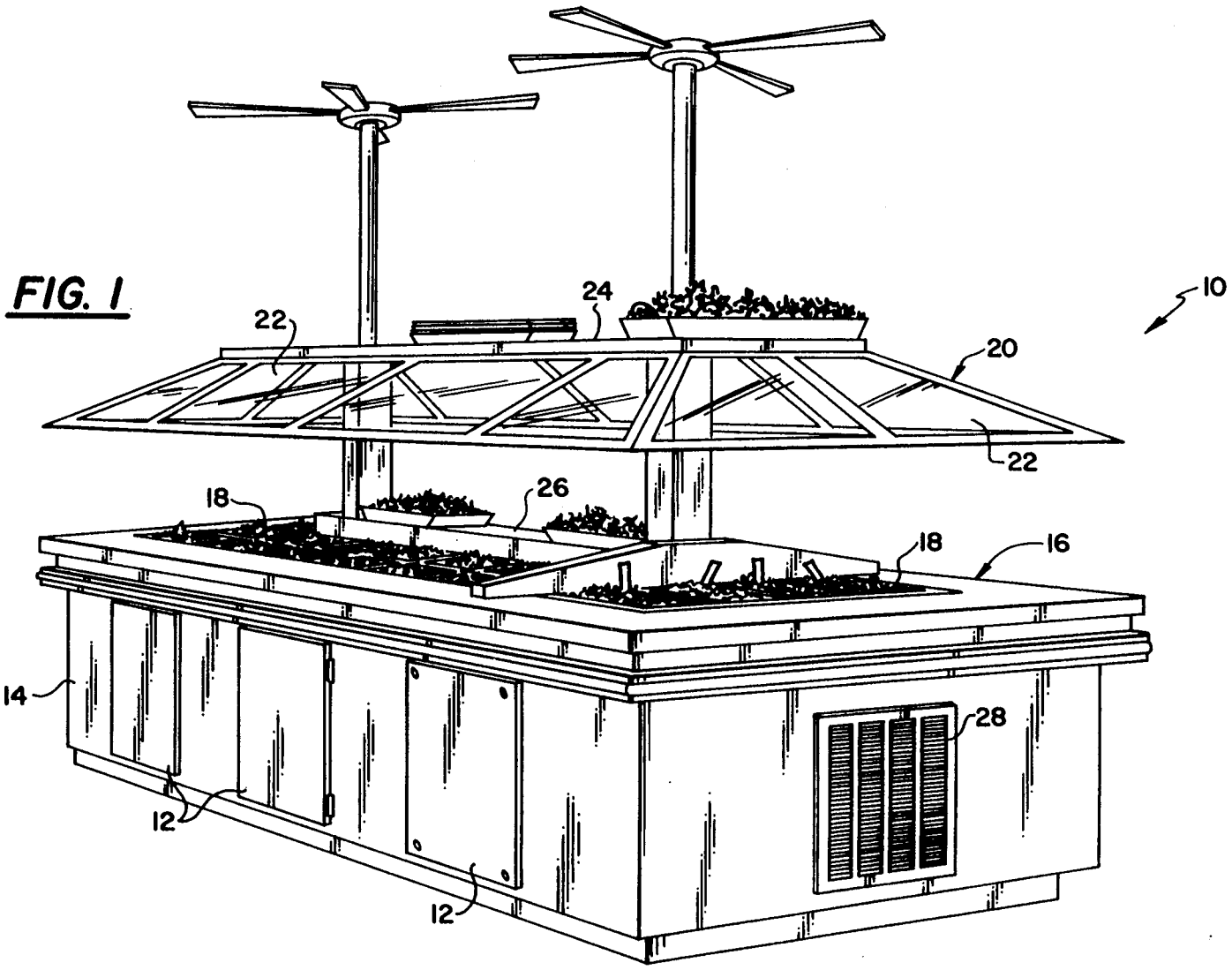
FIG. 1 is a perspective view of a food display and self serve unit in accordance with the invention.

A food display and self serve unit 10 in accordance with the invention is shown generally in FIG. 1. An exemplary form of the invention is a salad bar. But the unit could advantageously present a wide variety of food products including entrees and dessert items.

The unit 10 preferably includes one or more under cabinets 12 in its base 14 for storing supplies, such as containers of condiments and crackers, utensils and the like to replenish the bar. The food display surface or table top 16 of the unit may be divided into one or more service sections 18 and can include bins or containers for breads, lettuce or salads of various types, dressings and condiments, soup pots and the like.

A sneeze/cough guard 20 which includes a plurality of glass or clear plastic panes 22 is mounted to overlie the food display surface 16 to shield the same from dust and/or contamination from customers in the vicinity of the display unit 10. The mid portion of the sneeze guard cover can be a platform or flat support surface 24 on which, as shown, plates and utensils can be provided in close proximity to the bar. Another display or support portion 26 of the assembly is provided along the center line of the food display surface 16 and can receive, for example, baskets of breads, crackers and the like.

Figure 2:
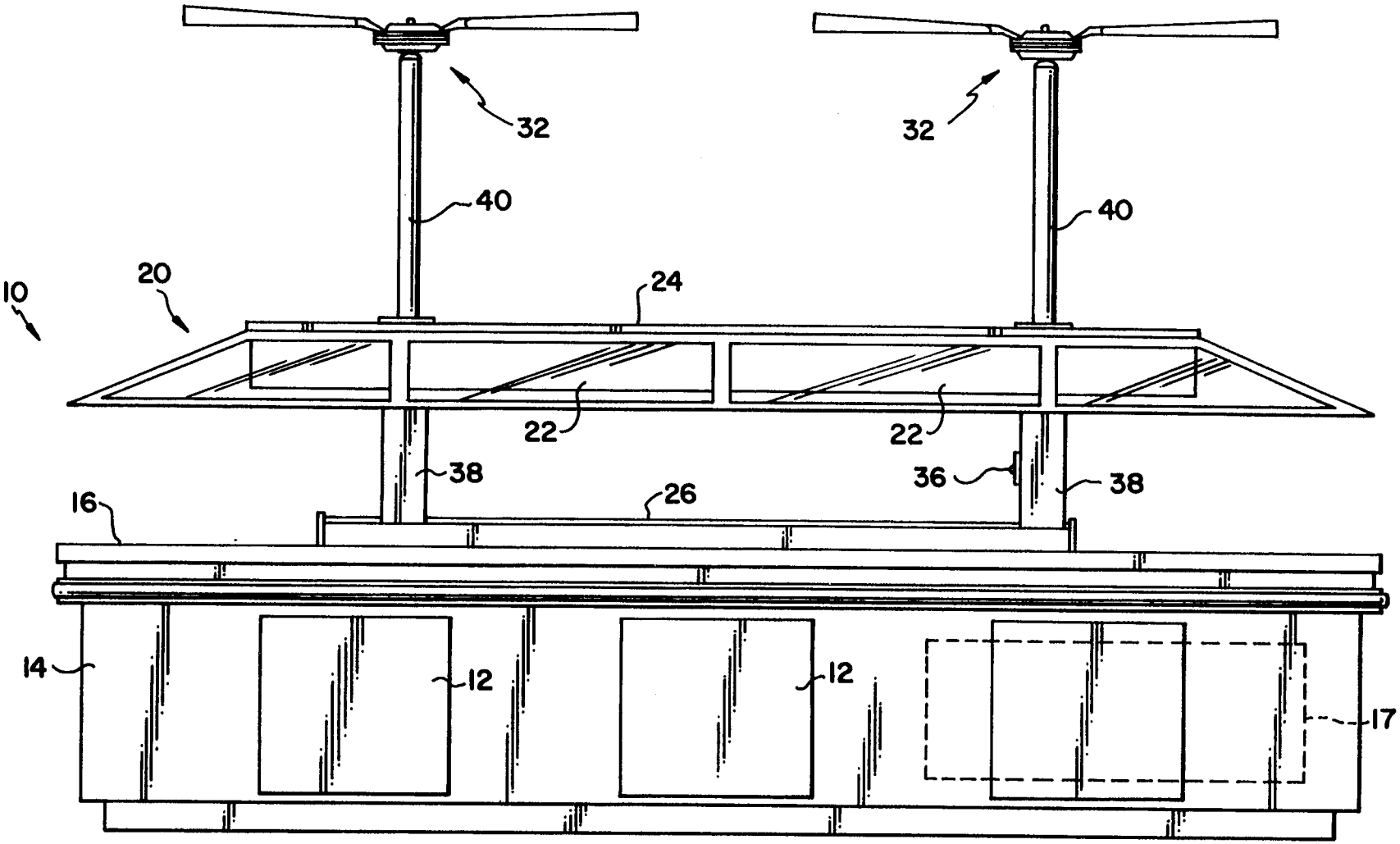
FIG. 2 is a front elevational view of a food display in accordance with the invention.

The unit 10 as a whole may be provided as a stand alone, semi-permanent unit as shown in particular in FIG. 2 or can have a plurality of wheels (not shown) mounted to the base thereof so that the unit can be selectively rolled to another location, either temporarily or semi-permanently. Such wheels can be detachable or self storing so that the unit is only selectively supported by wheels for movement. Even without wheels, as shown, the unit can be moved to another location within the store or restaurant or transferred to another building entirely.

The food service unit 10 may be a partially or wholly refrigerated unit which automatically cools the food display surface 16 and/or the compartments below. For example, the compartments may be mini-refrigerators or part or all of the interior of the base 14 of the unit 10 may be a refrigerator with several doors 12. Access for repair and maintenance of such units (shown schematically at 17) can be provided through one or more of the cabinet doors 12 or through removable panels 13 and ventilation for the motor can be provided through a vent opening 28 in the base of the unit. In the alternative or in addition, the food display surface 16 can be adapted to receive ice and to selectively drain melted ice water therefrom. As yet a further alternative, where entrees or soups are a part of the food products offered, one or more service sections 18 can be provided with heating elements for maintaining the product warm.

Figure 3:
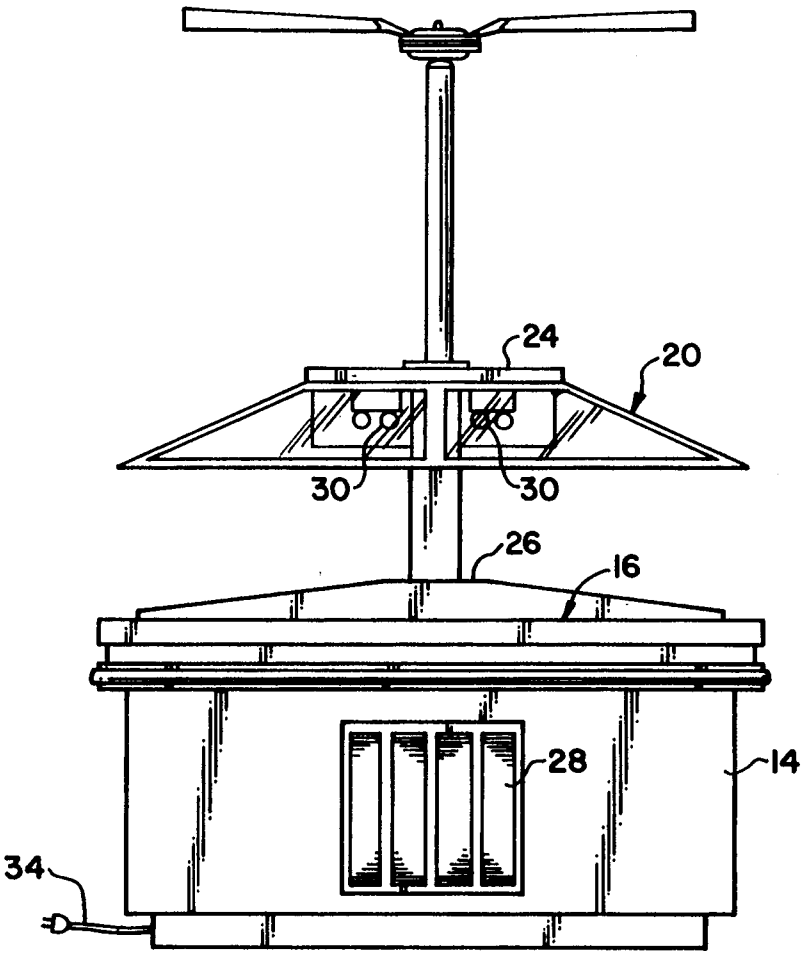
FIG. 3 is an end elevational view of a food display in accordance with the invention.
Figure 4:
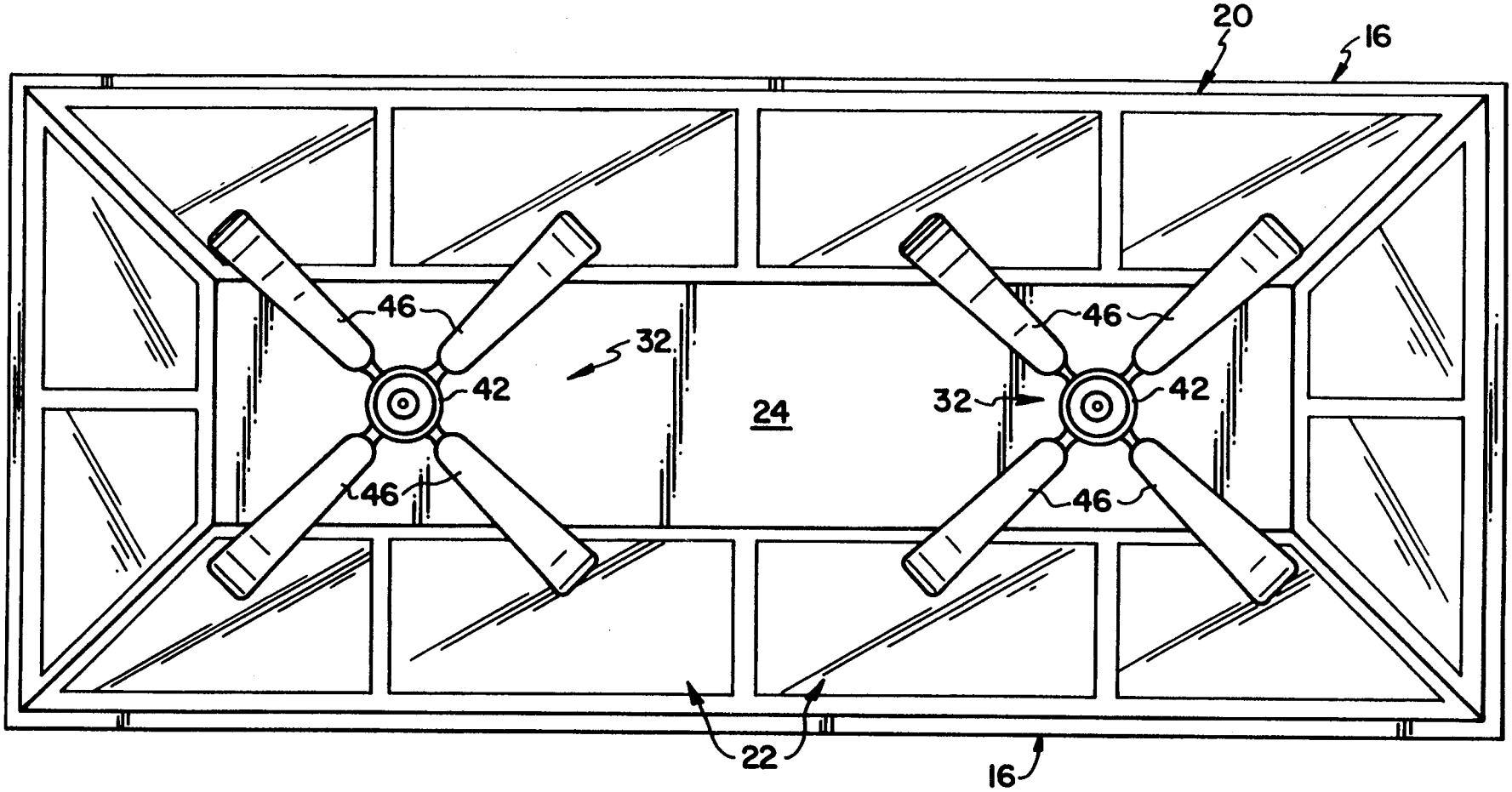
FIG. 4 is a top plan view of a food display in accordance with the invention.

One or more lights, such as florescent lights 30, are preferably mounted to the unit, for example, symmetrically on the undersurface of the sneeze guard platform 24. As shown in FIGS. 2 and 3, to conduct current to the lights 30, to the fans 32, which are described more particularly below, and to the motor(s) of the refrigerator unit(s), an electric cord 34 can be provided for selectively plugging the unit 10 in to a floor or wall outlet. A fan and/or light switch or switches 36 are conveniently located on the unit, for example, on one or both of the columns 38 which support the sneeze guard 20 and the fans 32, as described more particularly below.

Figure 5:
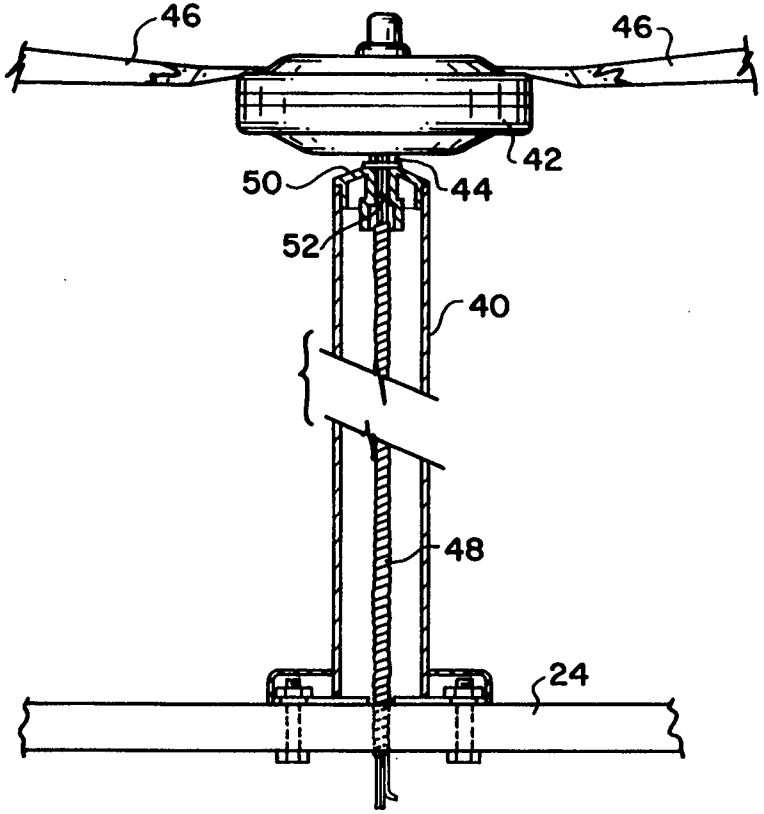
FIG. 5 is an elevational view, partly in cross-section and with parts omitted for clarity, of a fan assembly in accordance with the invention.

As shown in particular in FIGS. 2, 3 and 5, fans 32 are mounted above the sneeze guard 20 of the salad bar unit 10. In the illustrated embodiment, one fan 32 extends upwardly from each column or sneeze guard support pilar 38 of the unit 10. It is to be appreciated, however, that the unit could be designed to provide one air circulating fan. Likewise, more than two fans could be provided. For example, three or even four or more fans could be provided depending upon the size of the food display, the length of the fan blades and the like. When more than one fan unit is provided, furthermore, the fans could be provided at different heights or elevations to encourage air circulation throughout the air space above the food service unit.

In accordance with the preferred embodiment, the fans 32 are horizontally disposed paddle fan assembles and are rotated to direct air down to generate an air curtain which prevents fruit flies and the like from approaching the display surface. However, as an alternative, the fans may be rotated to draw air up from the food display surface for recirculation. Furthermore, the fans need not necessarily be paddle fans and/or could be oriented in another direction.

A preferred assembly for the fan unit 32 provided in accordance with the invention is shown in FIG. 5. A mounting tube or pipe 40 is fixedly secured to the top platform of the salad bar sneeze guard. A paddle fan unit 32 including a motor 42, shaft 44, and a plurality of fan blades or paddles 46 is mounted to the upper end of the pipe 40. The paddle fan motor unit is of conventional design and, therefore, a detailed illustration and explanation thereof is unnecessary. An electrical conduit 48 for conveying electrical energy to the paddle fan unit 32 extends through the mounting pipe or tube 40. A pipe cap 50 of, for example, steel is mounted to the vertically upper end of the mounting pipe 40 and suitably secured thereto. As shown, the pipe cap 50 includes a central supporting aperture 52 for receiving shaft 44 which extends downwardly from the paddle fan. Preferably, the cap 50 is threaded to the pipe 40 and the shaft 44 is threaded to the cap 50 so that the fan motor 42 is stably supported by the pipe 40 and cap 50. Thus, when the fan switch 36 on the column 38, for example, is actuated, electric current is allowed to flow to and through the electrical conduit 48 to the fan motor 42, so that the motor of the paddle fan can operate. Where more than one fan 32 is provided, as noted above, a switch 36 can be provided for each fan unit or a single switch can be provided to control two or more of the fans simultaneously.

While the invention has been described in connection with what is presently considered to be the most practical and preferred embodiment, it is to be understood that the invention is not to be limited to the disclosed embodiment, but, on the contrary, is intended to cover various modifications and equivalent arrangements included within the spirit and scope of the appended claims.

Thus, for example, the display unit of the invention could be used to display virtually any objects or products, whether or not edible, and could be of any desired shape including round, triangular, hexagonal, etc.

What is claimed is:

1. A display assembly comprising:

a base unit, said base unit having first and second sides, first and second ends, and an upper display surface;

a cover unit mounted so as to be in spaced overlying relation to said upper surface of said base unit; and at least one fan assembly mounted above said cover unit for circulating air above said upper surface, thereby to provide an air curtain for said upper surface;

wherein each said fan assembly is fixedly secured to said cover unit.

2. A display as in claim 1, wherein said cover unit is at least partially transparent to allowing viewing of said upper surface of said base unit while shielding the same from contamination.

3. A display as in claim 1, wherein first and second columnar supports extend between said base unit and said cover unit so as to mount and support said cover unit above said base unit.

4. A display as in claim 3, wherein a fan assembly is mounted above each said columnar support.

5. A display as in claim 4, further comprising switch means for actuating each said fan assembly.

6. A display as in claim 5, wherein said switch means are mounted to at least one of said columnar supports.

7. A display as in claim 1, wherein said cover unit overlies an area substantially coextensive with said upper surface.

8. A display as in claim 1, wherein each said fan assembly comprises a plurality of fan paddles mounted for rotation relative to said base unit.

9. A display as in claim 1, further comprising switch means for actuating each said fan assembly.

10. A display as in claim 1, wherein each fan assembly comprises a mounting pipe fixedly secured to said cover unit and extending vertically upwardly therefrom, a fan motor mounted to a vertically upper end of said mounting tube, and at least two fan paddles operatively coupled to and extending outwardly from said motor.

11. A display as in claim 1, wherein at least one of said fan assemblies is horizontally disposed so as to direct air substantially vertically one of toward and away from said upper surface.

12. A display as in claim 1, further comprising at least one light fixture for illuminating said upper surface of said base unit.

13. A display as in claim 1, wherein said base unit includes refrigeration means for refrigerating at least a portion of at least one of said upper surface and an interior of said base unit.

14. A display as in claim 1, further comprising a storage compartment within said base unit and at least one access door element for providing access to said compartment.

15. A display assembly comprising:

a base;

a table member having a display surface, said table member being mounted to and being supported by said base;

a cover member mounted so as to be in spaced overlying relation to at least at substantial portion of said display surface of said table member; and at least one fan assembly coupled to at least one of said cover member and said table member so as to be disposed vertically above said display surface for circulating air above said display surface, thereby to provide an air curtain for said upper surface.

16. A display as in claim 14, wherein at least one columnar support element is mounted to said table member and a said fan assembly is coupled to said support element.

17. A display as in claim 16, wherein said cover member is mounted to said table member and said at least one fan assembly is coupled to said cover member.

18. A display as in claim 17, wherein at least one columnar support element is mounted to said table member and to said cover member to thereby support said cover member above said table member.

19. A display as in claim 18, wherein first and second columnar support elements are provided and two fan assemblies are provided, one mounted so as to be vertically above each said columnar support element.

* * * * *